US005276660A

United States Patent [19]

Lee

[11] Patent Number: 5,276,660

[45] Date of Patent: Jan. 4, 1994

[54] COMPETITION WATERSKIER TIMING SYSTEM

[76] Inventor: Richard D. Lee, 934 Tyner, Incline Village, Nev. 89451

[21] Appl. No.: 891,562

[22] Filed: May 29, 1992

[51] Int. Cl.[5] ..... G04B 47/00; G04F 8/00

[52] U.S. Cl. ..... 368/10; 368/109

[58] Field of Search ..... 364/3, 9, 10, 107-113, 250, 251; 340/309.15, 309.4, 323, 384E

[56] References Cited

U.S. PATENT DOCUMENTS

| | | | |
|---|---|---|---|
| 3,952,155 | 4/1976 | Novak | 179/1 VE |
| 4,337,529 | 6/1982 | Morokawa | 368/10 |
| 4,392,122 | 7/1983 | Hocken | 340/323 R |
| 4,544,153 | 10/1985 | Babcock | 272/97 |
| 4,624,141 | 11/1986 | Soleau | 73/865.8 |
| 5,142,473 | 8/1992 | Davis | 364/424.01 |

*Primary Examiner*—Vit W. Miska

*Attorney, Agent, or Firm*—Fulwider, Patton, Lee & Utecht

[57] ABSTRACT

A timing system for providing consistent tow times in waterskiing competition by determining the position of the tow vehicle on the course relative a reference time and method of use are disclosed. The timing system includes timing means for indicating intermediate elapsed reference times that a tow vehicle would have if it was completing the course within the required time and speed tolerences, acutating means, electrically connected to the timer, for synchronizing the start of the timer with the entry of the vehicle on the course, and a communicator, electrically connected to the timer, to provides cues to the operator for comparison with the tow vehicle's actual position on the course. Methods for determining the position of the tow vehicle are also disclosed.

9 Claims, 2 Drawing Sheets

COMPETITION WATERSKIER TIMING SYSTEM

BACKGROUND OF THE INVENTION

1. Field of the Invention

The present invention relates generally to timing systems and, more particularly, to a new and improved apparatus and method for maintaining a desired tow vehicle speed along a predetermined slalom course.

2. Description of the Related Art

In competition slalom skiing, a tow vehicle, generally a ski boat, is used to tow all competitors in a given class. Standards and criteria are established by the American Water Ski Association (hereinafter referred to as "AWSA") as a means to provide a uniformity of tow. The goal of these standards is to give each competitor the same speed and type of pull through the course. This minimizes any variation between tows and allows competitors to compete against each other on an equal basis. A driver and a judge are required by the AWSA to be in the tow vehicle. The judge checks the elapsed time of the tow vehicle through the course to confirm that the pass is within a specified tolerance. A re-ride is awarded if the elapsed time is outside required limits.

Presently, the most common method of timing such passes uses a stopwatch held by a judge. During the pass, conventional boat speedometers are utilized by the driver to determine speed. There are numerous sophisticated electronic devices to check and confirm the boat's speed after completing the entire course to determine whether the pass was within the specified time tolerances, and thus at the appropriate speed. However, none of these devices allow the operator to adjust the speed of the tow vehicle while it is still on the course and thus provide a valid run. Instead, these methods and systems merely provide confirmation that the vehicle has completely traversed the course within the required time and speed tolerances after the completion of the run.

Hence those concerned with achieving uniform or consistent tow times through a water skiing slalom course have recognized the need for an improved system and method for aiding the driver of the tow vehicle to consistently complete the course within the desired required time by maintaining a correct speed along the course. The present invention clearly fulfills all of these needs.

SUMMARY OF THE INVENTION

Briefly, and in general terms, the present invention provides a new and improved timing system and method for achieving a consistent tow over a predetermined course.

The present invention is directed to an improved timing system and method for providing feedback to the tow vehicle operator and help maintain a desired constant speed over a predetermined slalom course. In one preferred embodiment of the present invention, the competition waterskiing timing system includes a timer programmed to include specified intermediate reference times equal to the amount of time it would take the tow vehicle to complete the intermediate segments of the course. A remote actuator, electronically connected to the timer, selectively starts the timer as the tow vehicle enters the course to synchronize the actual passage of the tow vehicle with the reference intermeditate elapsed times. The system then provides an audio cue at the end of each intermediate time to the tow vehicle operator for comparison with the actual position of the tow vehicle on the course. A method for determining the position of the tow vehicle relative such reference times is also disclosed.

From the above description, it can be readily seen that the present invention presents a new and useful system and method for aiding the operator of a tow vehicle to maintain the desired correct speed and positioning through a predetermined slalom course.

These and other objects and advantages of the present invention will become apparent from the following detailed description, taken in conjunction with the accompanying drawings, which illustrate, by way of example, the principles of the invention.

DETAILED DESCRIPTION OF THE INVENTION

As shown in the exemplary drawings, an improved timing system constructed and used in accordance with the present invention is provided for aiding the operator of the tow vehicle to achieve consistent travel times over a predetermined slalom course.

Figure 1:
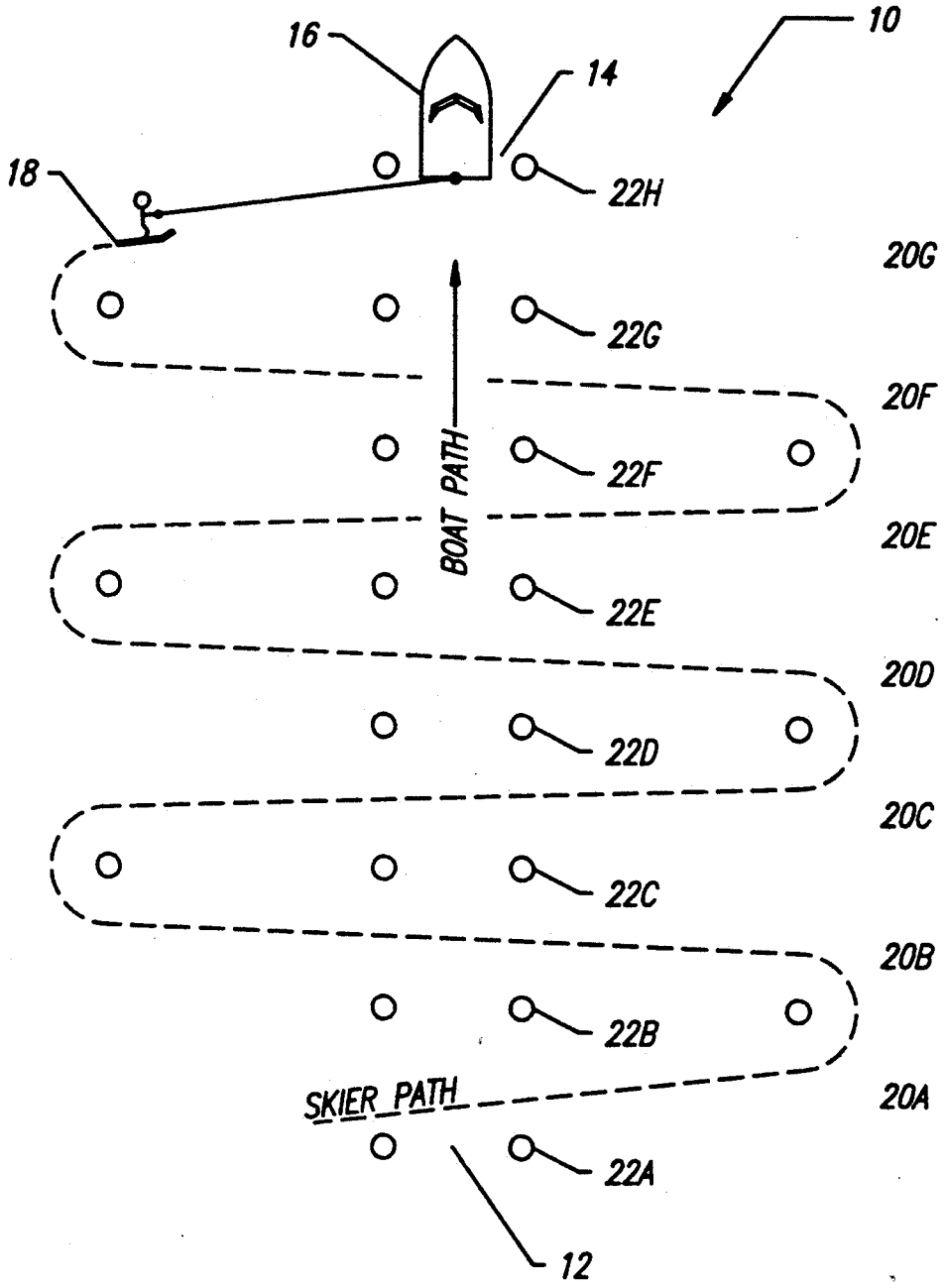
FIG. 1 is a generally top view of a waterskiing slalom course for use in conjunction with a tow vehicle and the timing system of the present invention.

As best shown in FIG. 1, there is shown the predetermined slalom course 10 having a beginning of the course 12 and an end of the course 14. A tow vehicle 16, pulling waterskier 18 is shown traversing the slalom course 10. The course 10 is divided into a plurality of intermediate segments by a plurality of intermediate reference points. The reference points may be in the form of conventional marker buoys. For example, in a typical slalom course 10, eight sets of buoys **22*a–h* are disposed along the course to divide it into a plurality of intermediate segments 20*a–g*. The inventor contemplates that the reference points 22*a–h* may also be in the form of electronic buoys or indicators positioned at any desired point throughout the course 10**.

Reference time periods, the total reference time and the individual intermediate reference times, are defined in terms of the time which elapses traveling between reference points. For example, the total reference time period is defined as the amount of time needed to completely traverse the course 10 and achieve the required speed. This can be, for example, from the slalom course beginning 12 to the end 14. Alternatively the reference time can be established by determining the elapsed time from the passage of the first reference point **22*a*, for example, the first buoy or entry gate, to the passage of the last reference point 22*h*, for example, the last marker buoy or exit gate. Each intermediate reference time is defined as the elapsed time of a tow vehicle moving through the course at a speed sufficient to complete the course 10** within the desired time and speed tolerences, as it travels between respective intermediate reference points along t he course. For example, the intermediate reference time could be the elapsed time as the tow vehicle passes between the beginning of the course, e.g., the first intermediate reference point 22*a* and the respective intermediate reference points 22*b–g*.

Figure 2:
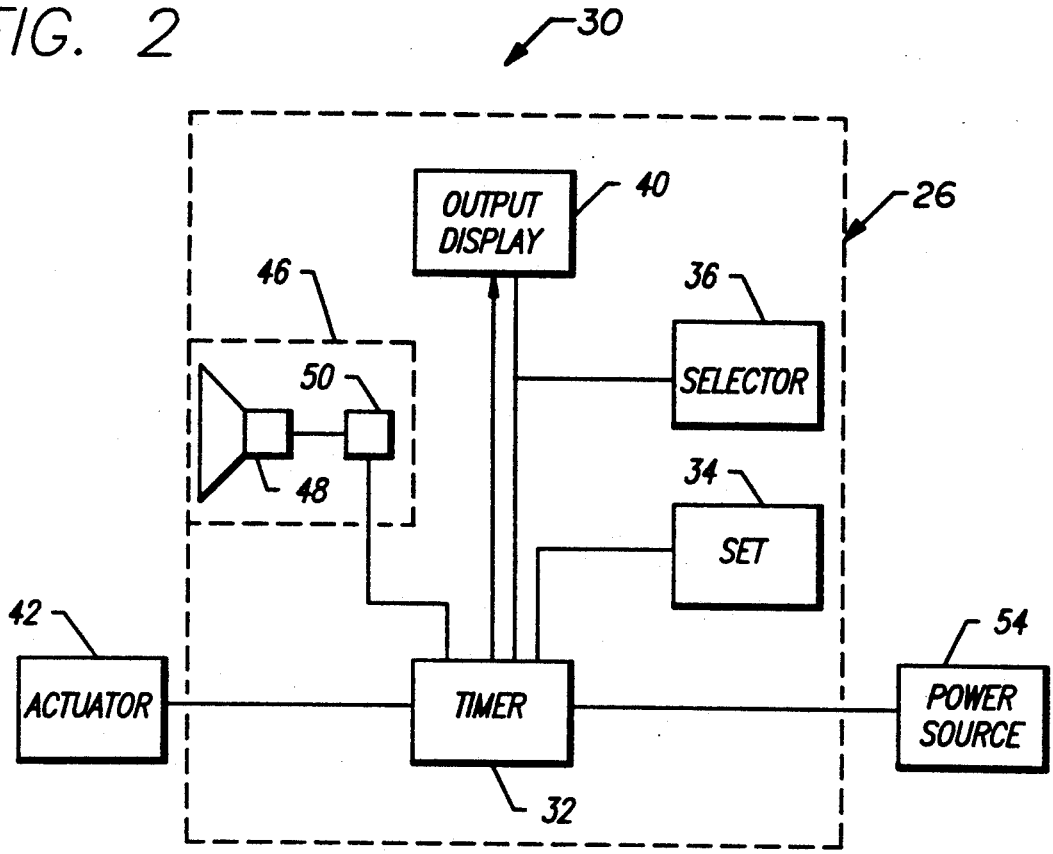
FIG. 2 is a block diagram of a timing system embodying the novel features of the present invention.

As best shown in FIG. 2, a timing system 26 for synchronizing the position of the tow vehicle 16 includes a housing 30 enclosing a timer 32. The timer 32 indicates or establishes to the system 26 the appropriate total and intermediate reference times. The total reference time and respective intermediate reference times are programmed into the timer 32. Other embodiments contemplated by the inventor include programs included within the timer 32 which could calculate the total and intermediate reference times after entry of the desired speed and respective distances of the particular course. The timer 32 thus provides intermediate reference times which represent the ideal or appropriate elapsed time that the tow vehicle would take to travel between or arrive at the respective marker, i.e., the desired appropriate location on the course 10, if the tow vehicle 16 were to complete the course within the desired time and speed tolerances. The timer 32 thus correlates the ideal position of the tow vehicle on the course 10 with the appropriate time and speed requirements of an appropriate pass.

The timer 32, in the preferred embodiment, will have a selector or switch 34 extending from the housing 30 and in electrical communication or electrically connected with the timer to allow the operator of the tow vehicle 16 to select a desired speed and thus determine the particular reference times. For example, two speeds are used in AWSA sanctioned tournaments, thirty-four mph and thirty-six mph, although at other times slower speeds are sometimes used. As a result, those skilled in the art can easily determine the appropriate reference times for programming into the timer 32. A time-set or input 36, which is in electrical communication or electrically connected to the timer 32 enables the operator to input the appropriate reference elapsed time and intermediate reference elasped times into the timer. The timer 32 may be connected to a light emitting diode or other equivalent display 40 to indicated which speed and thus which corresponding reference time has been selected.

An actuator 42 is in electrical communication or is electrically connected to the timer 32 to selectively start and stop the timer 32 and thus selectively synchronize the various intermediate reference times with the actual run on the course 10. In the preferred embodiment the actuator 42 may be in the form of a button mounted on the floor of the tow vehicle 16 to enable hands-off engagement of the timer 32 by the operator's foot. This is especially useful where the operator's hands are occupied by the operation of the tow vehicle 16.

A communicator 46 is electrically connected to the timer 32 to indicate the appropriate time for the tow vehicle to be at the respective intermediate reference point along the course by receiving signals from the timer and providing cues to the operator of the tow vehicle 16. The communicator 46 thus communicates or indicates to the tow vehicle operator the completion or elapsing of each respective intermediate reference times. The communicator 46 may include a cue generator 50 such that when a specified intermediate elapsed time period has elapsed or has been completed, the timer 32 will send a pulse to the cue generator 50 which in turn will send a cue to the operator at the desired time communicating the completion of each respective intermediate reference time period. In the preferred embodiment, the cue generator 50 is an audio cue generator, which may include a speaker 48 electrically connected to the timer 32. The audio cue can be a short pulsed beep sufficiently loud enough to be heard over the sound generated by the tow vehicle 16. At the same time, or in the alternative, a visual cue such as pulse strobe or other electronically generated cue may be used. As is well recognized by those in the art, the timing system 26 will include a power source or supply 54 electrically connected thereto to provide sufficient power to run the system. The power supply 54 may be in the form of a conventional independent battery cell or, in the alternative, a connection to the electrical system of the tow vehicle 16.

Figure 3:
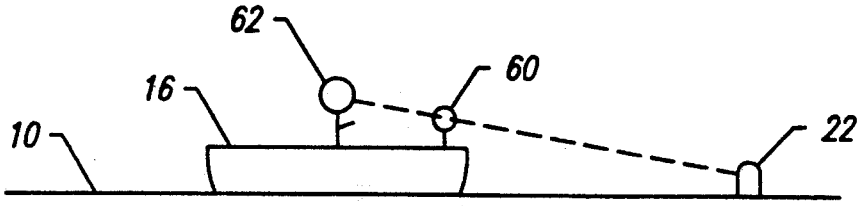
FIG. 3 is a generally lateral view of a tow vehicle, the timing system of the present invention, and operator on a slalom course.

As best shown in FIG. 3, the operator is also provided with a means for determining the position of the tow vehicle 16 on the course 10. A sight 60 is mounted or positioned on the tow vehicle 16 at a location which allows for the boat operator 62 to consistently or reproducibly sight one of the reference points 22 and thus enable the operator to determine the position of the tow vehicle 16 on the course 10. In the simplest embodiment, any structural feature on the tow vehicle 16 with which the operator can line up with a specific position on the course 10 would work. In the preferred embodiment, a sight 50 is mounted or formed on the tow vehicle 16 such that when the boat enters the course and passes an intermediate reference point 22 *a–g*, the operator can determine where the tow vehicle passes such mark or its position relative such mark when the signal from the cue generator 50 is activated or triggered. In still another embodiment, passage of the tow vehicle through a gate could break a beam of light running between the gates which could communicate such to the tow vehicle operator.

In operation, the operator dials in or selects the desired tow speed, for example, thirty-six mph. The timer 32 may already be programmed with the required reference times, such times may be generated by the timer if the appropriate program is included or such times may be directly inputed into the timer. The operator then commences the slalom pass on the course 10. The operator chooses a sight or reference point with which to gauge the passage of intermediate reference points 22*a–h* as they pass, for example, over his right shoulder, although other methods, including the sight 50 mounted on the tow vehicle, can be used. As the operator passes the first reference point 22*a* or enters into the course 10, he or she engages the actuator 42. The operator immediately hears, in the proferred embodiment, the first audio cue or beep and continues the pass attempting to hold the constant thirty-six mph. He will then hear an audio cue or beep as he passes each intermediate reference point (boat gate or buoy) 22*a–h* on the course 10 for a total of eight including the entry gate. The timer 32 is programmed so that if the operator precisely holds thirty-six mph, the beep or other cue will occur at the end of each respective intermediate reference time at the same time as intermediate reference point 22*a–h* on the course 10 passes his reference sight, e.g., over his shoulder or lines up with sight 50. Since the operator activated the timer 32 and thus synchronized the timing system 26 with the same time as entering the course 10, if he is going too fast, he will pass each subsequent intermediate reference point or buoy 22*a–h* before hearing the audio cue or beep. If he is going a little too slow, then he will hear the beep or other cue before he gets to each respective intermediate reference point or buoy. Thus, the operator of the tow vehicle can make minor speed adjustments through the course 10 between each buoy and achieve a much more consistent or timely pass with knowledge of where the tow vehicle is positioned on the course relative each intermediate reference point at the time of each respective cue indicating the passage of the respective intermediate reference time.

It will be appreciated from the foregoing that the present invention represents a significant advance in the field of waterskiing timing devices. In particular, the present invention provides a system and method to aid the operator of the tow vehicle while still on the course and thus acheive a consistent pass time within the required tolerances. It will be appreciated that, although the presently preferred embodiments of the invention have been described by way of example, various modifications may be made without departing from the spirit and scope of the invention. Accordingly, the present invention is not limited except as by the appended claims.

What is claimed is:

1. A system for determining the position of a tow vehicle relative an intermediate reference point along a predetermined course comprising:

timing means;

actuating means for selectively starting said timing means, said actuating means electrically conected to said timing means; and communicating means for indicating the appropriate time for said tow vehicle to be at said intermediate reference point of said predetermined course, said communicating means electrically connected to said timing means.

2. A system for determining the position of a tow vehicle along a predetermined course as set forth in claim 1, wherein said timing means includes means indicating intermediate reference times corresponding to traveling between respective intermediate reference points along said predetermined course.

3. A system for determining the position of a tow vehicle along a predetermined course as set forth in claim 1, wherein said actuating means includes a remote actuator, said remote actuator electrically connected to said timing means.

4. A system for determining the position of a tow vehicle along a predetermined course as set forth in claim 1, wherein said communicating means includes a cue generator for communicating the completion of each said intermediate reference times.

5. A system for determining the position of a tow vehicle along a predetermined course comprising:

timing means, wherein said timing means includes means indicating intermediate reference times corresponding to respective intermediate reference points along said predetermined course;

means for selectively actuating said timing means wherein said means for selectively actuating said timing means includes a remote actuator, said remote actuator electrically connected to said timing means; and communicating means for indicating the completion of each intermediate reference time for said tow vehicle to be at said respective intermediate reference points, where in said communicating means includes audio means for communicating the completion of each said intermediate reference times.

6. A system for regulating the speed of a tow vehicle in conjunction with a predetermined course having a beginning and intermediate reference points, said system comprising:

means for determining the position of said tow vehicle along said course;

means for indicating intermediate reference times corresponding to said intermendiate reference points;

means for synchronizing the position of said tow vehicle along said course with said intermediate reference times; and means for communicating the passage of said intermediate refernce times.

7. A system for regulating the speed of a tow vehicle as set forth in claim 6, wherein said means for determining the position of the tow vehicle includes sight means on said tow vehicle for determining the position of said tow vehicle relative said intermediate reference points.

8. A system for regulating the speed of a tow vehicle as set forth in claim 6 wherein said means for synchronizing the position of said tow vehicle along said course includes acuator means for starting said means for indicating intermediate reference times at said begining of said predetermined course.

9. A method for regulating speed of a tow vehicle along a predetermined course comprising the steps of:

laying out a pre-determined course with means to indicate position thereon;

determining intermediate reference times corresponding to that of said tow vehicle which traverses said course at a selected speed;

synchronizing said intermediate references time with traveling on said predetermined course; and determining the position of said tow vehicle along said course with reference to said intermediate reference times.

* * * * *